US008778260B2

(12) United States Patent
Tsuge et al.

(10) Patent No.: US 8,778,260 B2
(45) Date of Patent: Jul. 15, 2014

(54) DUPLEX STAINLESS STEEL

(75) Inventors: Shinji Tsuge, Tokyo (JP); Yuusuke Oikawa, Tokyo (JP); Shigeo Fukumoto, Tokyo (JP)

(73) Assignee: Nippon Steel & Sumikin Stainless Steel Corporation, Tokyo (JP)

( * ) Notice: Subject to any disclaimer, the term of this patent is extended or adjusted under 35 U.S.C. 154(b) by 29 days.

(21) Appl. No.: 11/991,671

(22) PCT Filed: Jun. 14, 2007

(86) PCT No.: PCT/JP2007/062471

§ 371 (c)(1),
(2), (4) Date: Mar. 6, 2008

(87) PCT Pub. No.: WO2008/018242

PCT Pub. Date: Feb. 14, 2008

(65) Prior Publication Data

US 2009/0098007 A1 Apr. 16, 2009

(30) Foreign Application Priority Data

Aug. 8, 2006 (JP) ..... 2006-215738

(51) Int. Cl.
*C22C 38/42* (2006.01)
*C22C 38/52* (2006.01)

(52) U.S. Cl.
CPC ..... *C22C 38/42* (2013.01)
USPC ..... 420/38; 420/41; 420/61; 420/40

(58) Field of Classification Search
USPC ..... 420/8–129
See application file for complete search history.

(56) References Cited

U.S. PATENT DOCUMENTS

| | | | | |
|---|---|---|---|---|
| 5,672,215 | A * | 9/1997 | Azuma et al. | 148/325 |
| 5,849,111 | A * | 12/1998 | Igarashi et al. | 148/325 |
| 2004/0042926 | A1 * | 3/2004 | Shimizu | 420/38 |

FOREIGN PATENT DOCUMENTS

| | | | |
|---|---|---|---|
| EP | 0 757 112 | | 2/1997 |
| JP | 01-100247 | | 4/1989 |
| JP | 01-100248 | | 4/1989 |
| JP | 3-82739 | A | 4/1991 |
| JP | 03082739 | A * | 4/1991 |
| JP | 07-278755 | | 10/1995 |
| JP | 2000-144342 | | 5/2000 |

(Continued)

OTHER PUBLICATIONS

Korean Office Action in Application No. 10-2008-1006096 dated Jan. 28, 2010 (English Translation).

(Continued)

*Primary Examiner* — Jie Yang
(74) *Attorney, Agent, or Firm* — Kenyon & Kenyon LLP

(57) ABSTRACT

The present invention provides duplex stainless steel superior in corrosion resistance in a chloride environment and impact properties suitable as a material for pumps for seawater desalination plants, facilities and equipment, and materials for chemical tanks, that is, duplex stainless steel characterized by containing, by mass %, C: 0.06% or less, Si: 0.05 to 3.0%, Mn: 0.1 to 6.0%, P: 0.05% or less, S: 0.010% or less, Ni: 1.0 to 10.0%, Cr: 18 to 30%, Mo: 5.0% or less, Cu: 3.0% or less, N: 0.10 to 0.40%, Al: 0.001 to 0.08% or less, Ti: 0.003 to 0.05%, Mg: 0.0001 to 0.0030%, and O: 0.010% or less, having a product of an activity coefficient $f_N$ of N, Ti content, and N content $f_N \times Ti \times N$ of $0.00004\%^2$ or more, and having a product of Ti content and N content $Ti \times N$ of $0.008\%^2$ or less.

14 Claims, 2 Drawing Sheets

(56) References Cited

FOREIGN PATENT DOCUMENTS

| | | | |
|---|---|---|---|
| JP | 2001-020046 | | 1/2001 |
| JP | 2002-030324 | | 1/2002 |
| JP | 2002-030395 | | 1/2002 |
| JP | 2002-069592 | | 3/2002 |
| JP | 2003-147489 | A | 5/2003 |
| JP | 2006-117991 | A | 5/2006 |
| JP | 2006-200035 | A | 8/2006 |

OTHER PUBLICATIONS

European Search Report dated Nov. 30, 2010 issued in corresponding EP Application No. 07745544.2.

* cited by examiner

DUPLEX STAINLESS STEEL

TECHNICAL FIELD

The present invention relates to duplex stainless steel superior in corrosion resistance used in chloride environments and other corrosive environments, more particularly the present invention steel relates to duplex stainless steel where the solidified structure is controlled to be fine so as to enable the provision of good mechanical properties as cast steel, thick forged steel, or a hot rolled steel material. For example, the present invention steel can be used as a material for pumps for seawater desalination plants, facilities and equipment, and materials for chemical tanks.

BACKGROUND ART

Duplex stainless steel has a ferrite phase in addition to an austenite phase generally considered to be resistant to embrittlement fracture, so the toughness is generally inferior to that of austenitic stainless steel.

As a factor behind the drop in toughness, in addition to the amount of the ferrite phase, the size of the solidified structure of the ferrite phase also has an effect. That is, the toughness is generally improved the greater the fineness of the structure, but duplex stainless steel solidifies at the single ferrite phase. The solidified structure is generally comprised of a coarse ferrite phase and an austenite phase finely precipitating at the grain boundaries and in the grains, so particularly in cast products, thick-gauge plate products, etc., the effects of the coarse ferrite phase are carried over as is to the final products.

As the techniques for increasing the fineness of the solidified structure, the techniques of electromagnetically agitating the cast slab during casting, controlling the overheating degree ΔT of the casting temperature to be small, etc. have been known, but these methods have the problems that they require bulky facilities and induce porosity defects. As opposed to this, there is the technique of utilizing TiN as the solidification nuclei. While this problem is small, it is liable to invite a drop in the toughness due to the introduction of nonmetallic inclusions, so it is necessary to study in detail the effects of increased fineness of the solidified structure and the harm due to the introduction of nonmetallic inclusions.

The inventors discloses the method of utilization of the action of nuclei of TiN on the δ iron in Japanese Patent No. 3624732, Japanese Patent No. 3624804, Japanese Patent No. 3446667, Japanese Patent No. 3458831, Japanese Patent Publication (A) No. 2002-69592, Japanese Patent Publication (A) No. 2006-117991, and Japanese Patent Publication (A) No. 1-100248.

Here, the first four patents relates to ferritic stainless steel, the next two patents relate to austenitic stainless steel having a high δ ferrite, and the final one patent relates to duplex stainless steel.

Among these, in particular the patents of Japanese Patent Publication (A) No. 2002-69592 and Japanese Patent Publication (A) No. 1-1002482 relate to inventions covering duplex stainless steel similar to the present invention, but all of these aim at improvement of the hot workability. Toughness is not considered at all.

Further, the first four patents relating to the ferritic stainless steel aim at improvement of the cold workability and toughness, but do not clearly give quantitative values relating to duplex stainless steel.

In the final analysis, there is no document clearly showing a realistic technique, for duplex stainless steel, for improving the toughness of cast steel and thick-gauge plate products aimed at by the present inventors.

DISCLOSURE OF THE INVENTION

The present invention has as its object the improvement of the impact properties of duplex thick-gauge stainless steel materials and has as its task the provision of duplex stainless steel superior in corrosion resistance by clarifying the method of control of the optimum Ti and N contents and Mg content in the chemical composition of this steel material.

The inventors prepared cast ingots by a melting experiment adding Ti and Mg in duplex stainless steel containing 0.10% or more of N and a refining experiment reducing the Mg from refractories or slag, observed the solidified structure of the cast slabs, hot rolled the cast slabs, and evaluated the impact properties of the obtained thick-gauge steel plates and as a result obtained the present invention.

The invention features, to improve the toughness, the need for precipitation of the TiN so as to increase the fineness of the solidified structure, but excessive TiN conversely impairs the toughness. Further, the lower limit of the precipitation is defined by the product of the N activity coefficient, Ti content, and N content, $f_N \times Ti \times N$, while the upper limit is defined by the product of the Ti content and N content, that is, Ti×N. The object of the present invention is achieved only in the range between the upper and lower limits.

That is, the present invention has as its gist the following:

(1) Duplex stainless steel characterized by containing, by mass %, C: 0.06% or less, Si: 0.05 to 3.0%, Mn: 0.1 to 6.0%, P: 0.05% or less, S: 0.010% or less, Ni: 1.0 to 10.0%, Cr: 18 to 30%, Mo: 5.0% or less, Cu: 3.0% or less, N: 0.10 to 0.40%, Al: 0.001 to 0.08%, Ti: 0.003 to 0.05%, Mg: 0.0001 to 0.0030%, and O: 0.010% or less, having a product of $f_N$, Ti content, and N content $f_N \times Ti \times N$ of $0.00004\%^2$ or more, having a product of Ti content and N content Ti×N of $0.008\%^2$ or less, in accordance with need containing one or more of V: 0.05 to 1.0%, Nb: 0.01 to 0.20%, W: 0.05 to 3.0%, Co: 0.05 to 1.0%, and having a balance of Fe and unavoidable impurities and (2) Duplex stainless steel superior in hot workability characterized by containing, by mass %, C: 0.06% or less, Si: 0.05 to 3.0%, Mn: 0.1 to 6.0%, P:0.05% or less, S: 0.0020% or less, Ni: 1.0 to 10.0%, Cr: 18 to 30%, Mo: 5.0% or less, Cu: 3.0% or less, N: 0.10 to 0.40%, Al: 0.010 to 0.08%, Ti: 0.003 to 0.05%, Mg: 0.0001 to 0.0030%, and O: 0.010% or less, having a product of $f_N$, Ti content, and N content $f_N \times Ti \times N$ of $0.00004\%^2$ or more, having a product of Ti content and N content Ti×N of $0.008\%^2$ or less, further containing one or more of B: 0.0005 to 0.0050%, Ca: 0.0005 to 0.0050%, and REM: 0.005 to 0.10%, and having a balance of Fe and unavoidable impurities and, in accordance with need, containing one or more of V: 0.05 to 1.0%, Nb: 0.01 to 0.20%, W: 0.05 to 3.0%, and Co: 0.05 to 1.0%:

where $f_N$ is a numerical value satisfying the following formula (1):

$$\log_{10} f_N = -0.046 \times Cr - 0.02 \times Mn - 0.011 \times Mo + 0.048 \times Si + 0.007 \times Ni + 0.009 \times Cu \quad (1)$$

each element is shown by content (%)

BEST MODE FOR CARRYING OUT THE INVENTION

Figure 1:
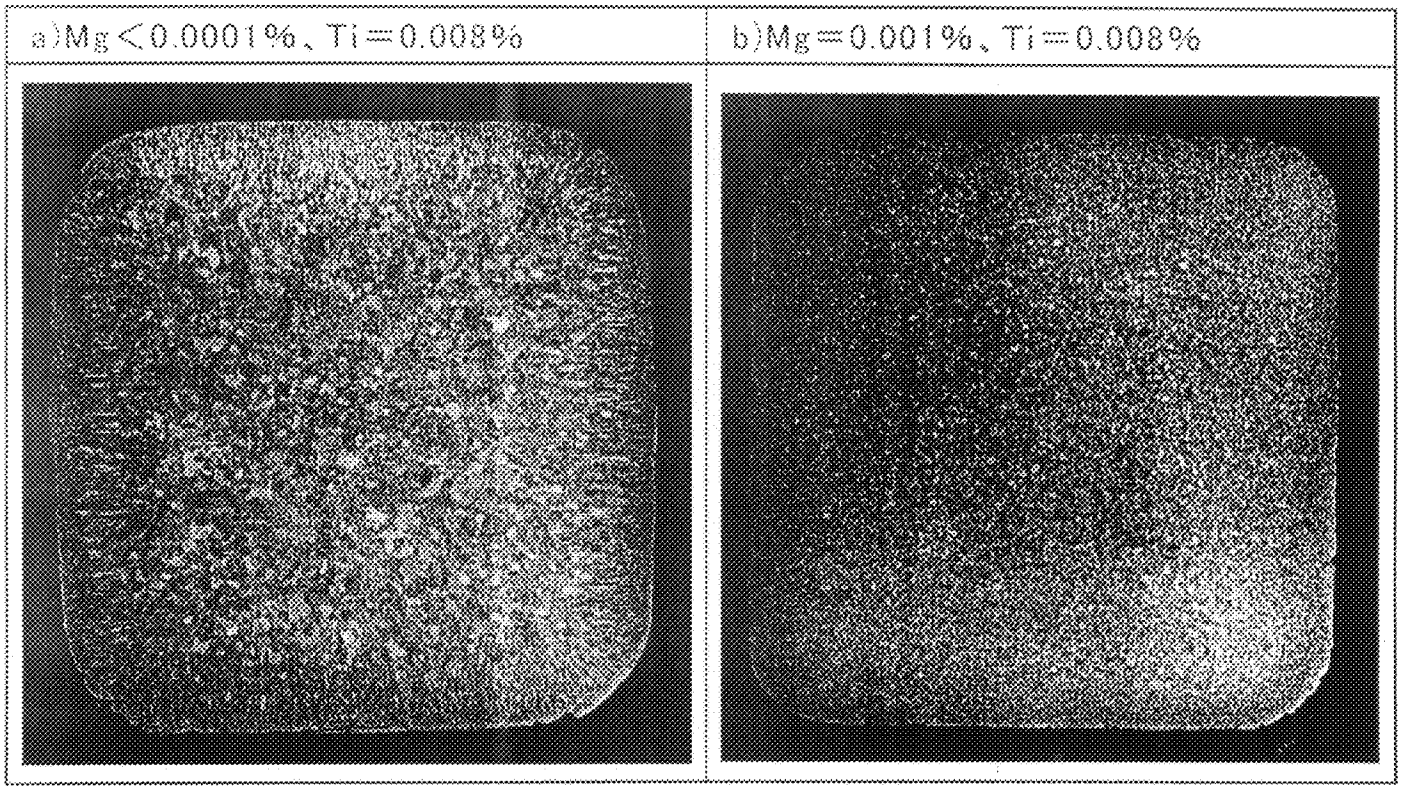
FIG. 1 shows an example of increasing the fineness of the macrostructure of the horizontal cross-section of a 50 kg steel ingot due to the combined addition of Ti and Mg, where a) shows the case of no addition of Mg and b) the case of addition of Mg.

Below, the reasons for limitation of the steel composition of duplex stainless steel defined in the present invention will be explained.

C is limited to a content of 0.06% or less to secure the corrosion resistance of stainless steel. If included in over 0.06%, Cr carbides are formed and the corrosion resistance and toughness deteriorate.

Si is added in an amount of 0.05% or more for deoxidation. However, if added over 3.0%, the toughness deteriorates. For this reason, the upper limit is limited to 3.0%. The preferable range is 0.2 to 1.5%.

Mn is added in an amount of 0.1% or more for deoxidation. However, if added over 6.0%, the corrosion resistance and toughness deteriorate. For this reason, the upper limit is made 6.0%. The preferable range is 0.2 to 2.0%.

P degrades the hot workability and toughness, so is limited to 0.05% or less, preferably, 0.03% or less.

S also degrades the hot workability, toughness, and corrosion resistance, so is limited to 0.010% or less, preferably 0.0020% or less.

Ni stabilizes the austenite structure and improves the corrosion resistance and further the toughness for various types of steel, so is included in an amount of 1.0% or more. On the other hand, it is an expensive alloy, so from the viewpoint of cost, is limited to a content of 10.0% or less.

Cr is included in an amount of 18% or more for securing the basic corrosion resistance. On the other hand, if included over 30%, intermetallic compounds more easily precipitate and impair the toughness. For this reason, the content of Cr was made 18% to 30%.

Mo is an element extremely effective for additionally raising the corrosion resistance of the stainless steel. In the present invention steel, it is included in a range of 5.0% or less. On the other hand, it is an extremely expensive element. Further, it is an element promoting the precipitation of intermetallic compounds along with Cr, so the upper limit was defined as 5.0% or less. The preferable content is 0.5 to 3.0%.

Cu is an element additionally raising the corrosion resistance of the stainless steel with respect to an acid and is included for this purpose in the range of 3.0% or less. If contained over 3.0%, the solid solubility is exceeded and ϵCu precipitates causing embrittlement, so the upper limit was made 3.0%. The preferable content is 0.3 to 2.0%.

N is an element effective for entering into solid solution in the austenite phase and raising the strength and corrosion resistance. For this reason, it is included in an amount of 0.10% or more. The solid solution limit becomes higher along with the Cr content, but if contained over 0.40%, it causes Cr nitrides to precipitate and impairs the toughness, so the upper limit of the content was made 0.40%. The preferable content is 0.10 to 0.35%.

Al is an important element for deoxidation of steel. To decrease the oxygen in the steel, it is included along with Si. When the Si content is over 0.3%, it sometimes need not be added, but reduction of the amount of oxygen is essential for securing the toughness. For this reason, inclusion of 0.001% or more is necessary. On the other hand, Al is an element with a relatively large affinity with N. If added in excess, AlN is formed and the toughness of the stainless steel is impaired. The extent depends on the N content as well, but if Al is over 0.08%, the drop in toughness becomes remarkable, so the upper limit of the content was set to 0.08%, preferably 0.05% or less.

Ti is an element forming oxide, nitrides, and sulfides in extremely fine amounts and increases the fineness of the crystal grains of the steel. In the present invention steel, it is a positively included element. In particular, in the present invention steel with a high N content, it forms TiN which acts as nuclei of δFe to increase the fineness of the ferrite grain size. For this purpose, together with the inclusion of Mg explained below, inclusion of 0.003% or more is necessary. On the other hand, if contained over 0.05%, even when the N content is the smallest, coarse TiN is formed and impairs the toughness of the steel. For this reason, the content was set at 0.003 to 0.05%. So long as the solidified structure of the steel becomes finer, the smaller the content of Ti, the more preferable in terms of securing the impact properties. The preferable content is 0.003 to 0.020%, more preferably 0.003 to 0.010%.

Mg dissolves in the steel and is present as an oxide such as MgO or $MgO \cdot Al_2O_3$. It acts as the nuclei for precipitation of TiN. The oxides of Mg themselves are also believed to act as nuclei for δFe. Through this, the Mg element is an element essential for increasing the fineness of the solidified structure under a small Ti and N content and is included for this reason. To include Mg, it is possible to add a metal Mg material to the molten steel or casting mold or possible to incorporate it by reduction from the refractories or slag. $MgO \cdot Al_2O_3$ is acid insoluble. The acid soluble Mg content and total Mg content of steel containing this are different in value, but here the content was found by analysis of the total Mg considering the fact that said oxide acts to increase the fineness of the solidified structure. The content of Mg required for increasing the fineness of the solidified structure depends on the Ti content as well, but has to be at least 0.0001%. On the other hand, if included in a large amount, the hard nonmetallic inclusions increase and thereby impair the toughness. For this reason, 0.0030% was made the upper limit of the content. The content of Mg is preferably as small as possible so long as the solidified structure of the steel is increased in fineness. If considering also the stability of realization of the increased fineness of the solidified structure, the preferable content is 0.0003 to 0.0015%.

The lower limit of the product of $f_N$, the Ti content, and the N content, $f_N \times Ti \times N$, is determined by whether TiN can be made to precipitate before the δFe precipitates. Here, $f_N$ is the activity coefficient of N. The relationship of formula (1) is satisfied in accordance with the composition of the steel. The coefficients relating to the contents of the elements defined in formula (1) are inter-assistant coefficients relating to the activity of N obtained from the recommended values of JSPS 19. In the present invention steel, the Ti content was extremely small, so the N activity correction term by Ti was ignored and formula (1) considering the effects due to the Cr, Ni, Cu, Mn, Mo, and Si contained in the two-phase stainless steel was considered.

Figure 2:
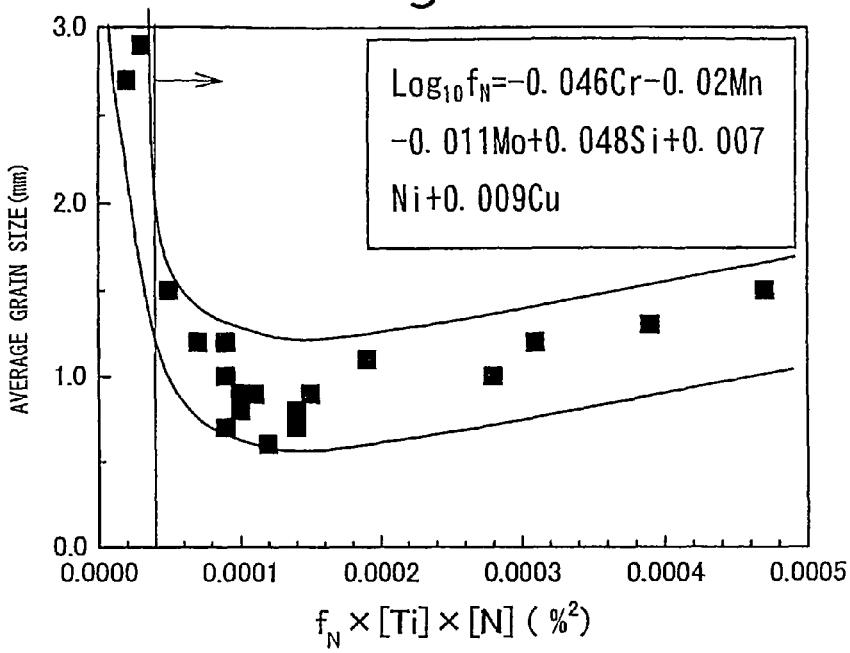
FIG. 2 is a view showing the relationship between the ferrite crystal grain size and $f_N \times Ti \times N$ of duplex stainless cast steel containing Mg.

The inventors included 0.0001 to 0.0030% of Mg in duplex stainless steel containing Ti in a small amount of 0.05% or less in range and containing N in an amount of 0.1% or more and searched and researched the conditions for increasing the fineness of the solidified structure. As a result, they learned that, in Mg-containing duplex stainless steel, the lower limit of the $f_N \times Ti \times N$ enabling increased fineness of the ferrite crystal grain size is $0.00004\%^2$ and set it at $0.00004\%^2$ (see FIGS. 1 and 2).

Figure 3:
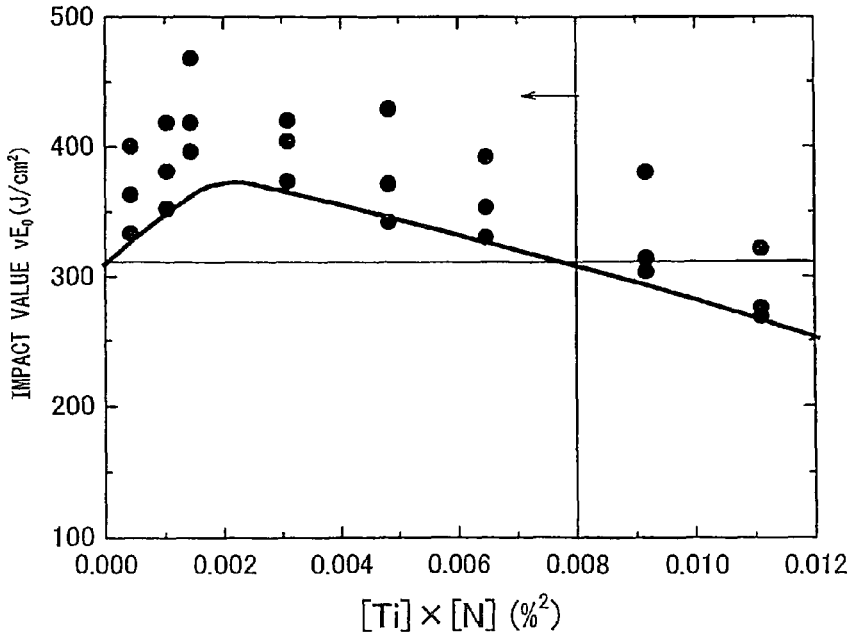
FIG. 3 is a view showing the relationship between the Ti×N content and impact properties in thick-gauge steel plate of 25% Cr-5% Ni-0.3% Mo-1.5% Cu-0.22% N-based duplex stainless Mg-containing steel (Mg content of about 0.001%).

On the other hand, the toughness of the steel is affected by both the size and amount of the nonmetallic inclusions. The inventors studied the effects of the amounts of Ti and N on the toughness of thick-gauge steel plate and as a result obtained the data that the larger the Ti×N, the more the toughness is impaired (see FIG. 3), so based on this set the product of the Ti content and N content Ti×N to $0.008\%^2$ or less.

O is an important element forming oxides typical of nonmetallic inclusions. Excessive inclusion inhibits the toughness. Further, if coarse cluster-shaped oxides are formed, they become causes of surface defects. For this reason, the upper limit of the content was set at 0.010%, preferably 0.005% or less.

Next, the reasons for limitation described in claim 2 of the present invention will be explained.

V, Nb, and W are elements selectively added for additionally raising the corrosion resistance of duplex stainless steel.

V is included in an amount of 0.05% or more for the purpose of improving the corrosion resistance, but if included in over 1.0%, coarse V-based carbonitrides are formed and the toughness deteriorates. For this reason, the upper limit is limited to 1.0%. The preferable content in the case of addition is 0.1 to 0.5% in range.

Nb is included in an amount of 0.01% or more to improve the corrosion resistance. On the other hand, Nb is an element more powerful than V in forming carbides and nitrides, suppresses crystal grain growth, and acts to strengthen the steel material. For this reason, excessive addition impairs the toughness, so the upper limit of the content was set to 0.20%. The preferable range of content in the case of addition is 0.05% to 0.15%.

W, like Mo, is an element additionally raising the corrosion resistance of stainless steel and has a larger solid solubility compared with Nb and V. In the present invention steel, to improve the corrosion resistance, 0.05 to 3.0% is included.

Co is an element effective for raising the corrosion resistance and toughness of steel and is selectively added. If the content is less than 0.05%, there is little effect, while if included over 1.0%, the effect becomes saturated. This is an expensive element, so an effect commensurate with the cost is not exhibited. Therefore, the content in the case of addition was set to 0.05 to 1.0%.

Furthermore, to improve the hot workability, in the elements described in claim 3 of the present invention, S and Al and B, Ca, Mg, and REM are limited as explained below.

S is an element harmful to the hot workability. To hot roll duplex stainless steel with a good yield, the amount of S has to be made 0.0020% or less. For this reason, the upper limit is set to 0.0020%.

Al is an element required for not only deoxidation of steel, but also desulfurization and has to be included in an amount of 0.010% or more. The upper limit is 0.080%.

B, Ca, and REM are all elements improving the hot workability of steel and are added for that purpose alone or in combination. Excess addition of any of B, Ca, and REM conversely lowers the hot workability and toughness, so the upper and lower limits of content were set as follows: For B and Ca, 0.0005 to 0.0050%, while for REM, 0.005 to 0.10%. Here, REM indicates the total of the contents of the La, Ce, and other lanthanoid rare earth elements.

EXAMPLES

Below, examples will be explained. Table 1 shows the chemical compositions of the steels used. Note that in addition to the ingredients described in Table 1, Fe and unavoidable impurity elements are contained. Further, the ingredients shown in Table 1 are of the impurity level when the contents are not described. Further, the REM in the table means lanthanoid rare earth elements. The content shows the total of these elements.

TABLE 1

| No. | | Flux charging | C | Si | Mn | P | S | Ni | Cr | Mo | Cu | V | Nb | W |
|---|---|---|---|---|---|---|---|---|---|---|---|---|---|---|
| 1 | Inv. | | 0.013 | 0.48 | 0.90 | 0.028 | 0.0014 | 5.02 | 24.90 | 0.30 | 1.48 | — | — | — |
| 2 | ex. | | 0.021 | 0.33 | 0.32 | 0.038 | 0.0052 | 7.14 | 25.13 | 4.15 | 1.85 | — | — | — |
| 3 | | | 0.015 | 0.51 | 0.89 | 0.025 | 0.0006 | 5.03 | 25.12 | 0.30 | 1.51 | 0.13 | — | 0.31 |
| 4 | | ○ | 0.015 | 0.51 | 0.89 | 0.025 | 0.0002 | 4.99 | 25.23 | 0.29 | 1.45 | 0.12 | — | 0.28 |
| 5 | | ○ | 0.015 | 0.49 | 0.88 | 0.026 | 0.0002 | 5.05 | 25.05 | 0.29 | 1.53 | 0.13 | — | 0.30 |
| 6 | | | 0.025 | 0.75 | 5.02 | 0.025 | 0.0008 | 1.52 | 21.58 | 0.30 | 0.32 | — | — | — |
| 7 | | ○ | 0.013 | 0.51 | 1.74 | 0.024 | 0.0001 | 3.85 | 23.21 | 0.30 | 0.32 | — | — | — |
| 8 | | ○ | 0.016 | 0.51 | 0.49 | 0.025 | 0.0005 | 4.23 | 22.85 | 0.36 | 0.25 | — | — | — |
| 9 | | | 0.021 | 0.68 | 1.72 | 0.022 | 0.0005 | 5.80 | 22.31 | 3.12 | 0.11 | — | — | — |
| 10 | | | 0.020 | 0.65 | 0.90 | 0.022 | 0.0005 | 6.51 | 26.53 | 1.52 | 0.83 | — | — | — |
| 11 | | | 0.020 | 0.65 | 0.90 | 0.022 | 0.0005 | 6.50 | 26.50 | 0.80 | 0.80 | — | 0.12 | — |
| 12 | | | 0.016 | 0.32 | 0.88 | 0.022 | 0.0005 | 7.03 | 25.14 | 3.32 | 0.45 | 0.15 | — | 0.25 |
| 13 | | | 0.013 | 0.28 | 0.43 | 0.021 | 0.0004 | 6.80 | 25.23 | 3.24 | 0.48 | 0.12 | — | 2.06 |
| 14 | | | 0.021 | 0.49 | 0.51 | 0.018 | 0.0005 | 7.10 | 25.20 | 4.10 | 0.08 | — | — | — |
| 15 | | | 0.018 | 0.52 | 0.90 | 0.022 | 0.0005 | 8.52 | 28.53 | 1.50 | 0.80 | — | — | — |
| 16 | | | 0.016 | 2.86 | 3.23 | 0.017 | 0.0015 | 3.43 | 18.53 | 0.12 | 1.23 | — | — | — |
| A | Co. | | 0.013 | 0.48 | 0.90 | 0.028 | 0.0004 | 5.02 | 24.90 | 0.30 | 1.48 | — | — | — |
| B | ex. | | 0.018 | 0.51 | 0.90 | 0.003 | 0.0012 | 5.01 | 24.95 | 0.31 | 1.53 | — | — | — |
| C | | | 0.015 | 0.51 | 0.89 | 0.025 | 0.0006 | 4.80 | 25.12 | 0.30 | 1.51 | 0.13 | — | 0.31 |
| D | | | 0.014 | 0.47 | 0.85 | 0.023 | 0.0004 | 5.03 | 25.23 | 0.30 | 1.46 | 0.08 | — | 0.12 |
| E | | | 0.012 | 0.22 | 0.88 | 0.025 | 0.0012 | 4.99 | 24.93 | 0.29 | 1.48 | — | — | — |

| No. | | Co | N | Al | Ti | Mg | B | Ca | REM | $f_N \times$ Ti × N | Ti × N | O |
|---|---|---|---|---|---|---|---|---|---|---|---|---|
| 1 | Inv. | — | 0.217 | 0.015 | 0.008 | 0.0008 | — | — | — | 0.00014 | 0.0017 | 0.0035 |
| 2 | ex. | 0.15 | 0.292 | 0.033 | 0.018 | 0.0026 | — | — | — | 0.00039 | 0.0053 | 0.0036 |
| 3 | | — | 0.225 | 0.021 | 0.005 | 0.0006 | — | — | — | 0.00009 | 0.0011 | 0.0032 |
| 4 | | — | 0.218 | 0.012 | 0.018 | 0.0001 | — | — | — | 0.00031 | 0.0039 | 0.0028 |

TABLE 1-continued

| | | | | | | | | | | | | |
|---|---|---|---|---|---|---|---|---|---|---|---|---|
| 5 | | 0.12 | 0.215 | 0.025 | 0.032 | 0.0003 | — | — | — | 0.00055 | 0.0069 | 0.0021 |
| 6 | | — | 0.223 | 0.025 | 0.007 | 0.0015 | 0.0023 | 0.0025 | — | 0.00014 | 0.0016 | 0.0034 |
| 7 | | — | 0.145 | 0.032 | 0.012 | 0.0005 | — | — | — | 0.00015 | 0.0017 | 0.0014 |
| 8 | | — | 0.115 | 0.023 | 0.042 | 0.0008 | — | — | — | 0.00047 | 0.0048 | 0.0021 |
| 9 | | — | 0.185 | 0.018 | 0.005 | 0.0023 | — | 0.0022 | — | 0.00009 | 0.0009 | 0.0032 |
| 10 | | — | 0.220 | 0.025 | 0.008 | 0.0005 | — | 0.0028 | — | 0.00012 | 0.0018 | 0.0032 |
| 11 | | — | 0.220 | 0.052 | 0.007 | 0.0008 | — | — | 0.032 | 0.00011 | 0.0015 | 0.0024 |
| 12 | | — | 0.245 | 0.025 | 0.005 | 0.0005 | — | 0.0030 | — | 0.00009 | 0.0012 | 0.0029 |
| 13 | | 0.31 | 0.320 | 0.025 | 0.008 | 0.0002 | 0.0025 | 0.0024 | — | 0.00019 | 0.0026 | 0.0026 |
| 14 | | — | 0.256 | 0.042 | 0.004 | 0.0003 | 0.0021 | 0.0022 | — | 0.00007 | 0.0010 | 0.0018 |
| 15 | | — | 0.345 | 0.032 | 0.005 | 0.0007 | 0.0026 | 0.0023 | — | 0.00010 | 0.0017 | 0.0033 |
| 16 | | — | 0.120 | 0.005 | 0.013 | 0.0002 | — | — | — | 0.00028 | 0.0016 | 0.0033 |
| A | Co. | — | 0.217 | 0.054 | 0.001 | <0.0001 | — | — | — | 0.00002 | 0.0002 | 0.0028 |
| B | ex. | — | 0.243 | 0.053 | 0.038 | <0.0001 | — | — | — | 0.00074 | 0.0092 | 0.0031 |
| C | | — | 0.126 | 0.036 | 0.003 | 0.0026 | — | 0.0032 | — | 0.00003 | 0.0004 | 0.0038 |
| D | | — | 0.225 | 0.021 | 0.065 | 0.0009 | — | 0.0029 | — | 0.00114 | 0.0146 | 0.0028 |
| E | | — | 0.222 | 0.002 | 0.006 | 0.0022 | — | — | — | 0.00010 | 0.0013 | 0.0110 |

$\log_{10}f = -0.046Cr - 0.02Mn - 0.011Mo + 0.048Si + 0.007Ni + 0.009Cu$: outside scope of the present invention These steels were produced in an MgO crucible in a laboratory use 50 kg vacuum induction furnace. Ti and Mg were added and the contents in the steels were controlled. In the production of part of the steels, $CaO—MgO—Al_2O_3—CaF_2$ flux was charged to promote deoxidation and desulfurization. The basicity of the flux, MgO content, and amount of Al of the steels were changed to reduce the MgO of the refractories and flux and change the Mg content in the steels.

The thus produced steels were made into flat steel ingots of about 100 mm or were split cast to produce steel ingots of a thickness of about 70 mm.

The horizontal cross-sections of the steel ingots were examined in macrostructure. The macrostructures could be divided into ones where the surface layers were columnar crystals (FIG. 1-*a*)) and ones where the entire structures were fine equiaxial crystals (FIG. 1-*b*)). The ones where the entire structures solidified to fine equiaxial crystals all exhibited fine structures of ferrite grain sizes of around 1 mm (FIG. 1-*b*) and FIG. 2). The ferrite phase ratios were measured for these macro samples by a ferrite meter. As a result, they were in the range of 30 to 70%. Further, the inventors solubilized and heat treated the steels at 1000 to 1100° C. in accordance with their compositions, then took 10 to 14 JIS No. 4 2 mm V-notched full size Charpy test pieces from the center parts, ran impact tests near room temperature at increments of 20° C., and measured the transition temperature. Further, to evaluate the high temperature ductility, they took 8 mm diameter smooth rod test pieces from the surface layers of the steel ingots and used a Thermorester® tester to run high temperature tensile tests. The test pieces were heated at 1200° C. for 30 seconds, then were raised to the test temperature, held there for 30 sec, then subjected to tension by a 20 mm/sec crosshead rate until breaking and the sectional shrinkage rate (=drawing rate) found. The lowest drawing rate is exhibited at the test temperature of 900° C., so the results were evaluated by the drawing rate at this temperature.

Materials for hot rolling were taken from the main parts of the steel ingots, heated to a temperature of 1100 to 1250° C. for 1 to 2 hours in accordance with the ingredients, and rolled under conditions of a finishing temperature of 950 to 850° C. to obtain 12 mm thick hot rolled steel plate. Note that after the rolling, the steel materials were spray cooled in the state of a temperature of 800° or more down to 200° C. or less. The final solubilization and heat treatment were performed under conditions of 1000 to 1100° C.×20 minutes' soaking followed by water cooling.

Three JIS No. 4 V-notch Charpy test pieces were cut out, in directions perpendicular to rolling, from each of the thick-gauge steel plates obtained under the above production conditions. The plates were given N notches so that the breakage propagates in the rolling direction. The impact values at 0° C. were measured by a tester with a maximum energy 500 J specification.

The macrostructure of the steel ingots, the impact transition temperatures of the steel ingot, the drawing at 900° C., and the impact value in the direction perpendicular to rolling of thick-gauge steel plate at 0° C. obtained by the above evaluation are shown in Table 2. The "good" in the column of the macrostructure indicates an overall equiaxial crystal structure, while "poor" indicates a structure in which columnar crystals are formed at the surface layer. Each of the invention steels exhibited "good" structures. The impact transition temperature shows the energy transition temperature. In the steel ingots of the present invention, good values of 0° C. or less were exhibited. Further, in the steels according to claims 3 and 4 improved in hot workability, the drawing rates at 900° C. were all over 70%. Even in the steels of Nos. 4, 5, 7, and 8 using flux for desulfurization refining in the steels of claims 1 and 2, values of over 70% or more were shown. The impact value of thick-gauge steel plate, in the present invention steel, is a high value of about 300 J/cm$^2$ or more. Among these, No. 15 with an S over 0.005% and No. 2 with a Cr over 28% exceptionally show impact values of less than 300 J/cm$^2$, but in these, the detrimental effect on the impact properties of S and Cr is believed to be slightly higher than the effect due to the increased fineness of the solidified structure. Whatever the case, good values of 250 J/cm$^2$ or more are shown.

TABLE 2

| No. | | claim | Macro-structure of steel ingot | Impact transition temperature of steel ingot (° C.) | 900° C. drawing (%) | Impact value of thick-gauge steel plate vE0 (J/cm$^2$) |
|---|---|---|---|---|---|---|
| 1 | Inv. | 1 | Good | −20 | 52 | 400 |
| 2 | ex. | 1 | Good | −10 | 35 | 260 |
| 3 | | 2 | Good | −10 | 53 | 410 |
| 4 | | 2 | Good | −10 | 71 | 350 |
| 5 | | 2 | Good | 0 | 76 | 320 |
| 6 | | 3 | Good | −20 | 79 | 330 |
| 7 | | 1 | Good | −30 | 82 | 310 |
| 8 | | 1 | Good | −10 | 71 | 300 |
| 9 | | 3 | Good | −10 | 79 | 390 |
| 10 | | 3 | Good | −10 | 80 | 340 |
| 11 | | 4 | Good | −10 | 81 | 300 |
| 12 | | 4 | Good | 0 | 79 | 320 |
| 13 | | 4 | Good | 0 | 77 | 300 |

TABLE 2-continued

| No. | | claim | Macro-structure of steel ingot | Impact transition temperature of steel ingot (° C.) | 900° C. drawing (%) | Impact value of thick-gauge steel plate vE0 (J/cm$^2$) |
|---|---|---|---|---|---|---|
| 14 | | 3 | Good | 0 | 76 | 310 |
| 15 | | 3 | Good | 0 | 76 | 280 |
| 16 | | 1 | Good | −10 | 60 | 340 |
| A | Co. | | Poor | 10 | 60 | 240 |
| B | ex. | | Good | 20 | 53 | 220 |
| C | | | Poor | 30 | 76 | 250 |
| D | | | Good | 20 | 77 | 230 |
| E | | | Poor | 20 | 51 | 240 |

In the comparative examples, it will be understood that when containing Ti and N in large amounts, an increased fineness of the solidified structure is realized like in No. B and D, but in this case, the impact transition temperature of the steel ingot is high and the impact value of the thick-gauge steel plate is low. Further, when $f_N \times Ti \times N$ does not satisfy 0.00004%$^2$, the solidified structure is not made finer and the impact transition temperature of the steel ingot becomes a high value of 10° C. or more. Further, in No. E where the deoxidation is insufficient and the amount of oxygen is over 0.010%, even if Ti and Mg are suitably contained, the macrostructure of the steel ingot was coarse and the transition temperature was also a high 20° C.

As clear from the results of Table 1 and Table 2, in the invention examples, it is clear that the macrostructure of the steel ingot is increased in fineness and a good impact transition temperature is shown. In the steels of claims 3 and 4, it is clear that a good high temperature ductility is exhibited and the impact value of thick-gauge steel plate is a good value of 250 J/cm$^2$ or more.

As will be understood from the above examples, it becomes clear that according to the present invention, duplex stainless steel with a good toughness and hot workability can be obtained.

Industrial Applicability

According to the present invention, it becomes possible to provide duplex stainless steel superior in corrosion resistance in a chloride environment and impact properties more than the present, possible to use the present invention steel for example as a material for pumps for seawater desalination plants, facilities and equipment, and materials for chemical tanks, and otherwise contribute extremely greatly to industry.

The invention claimed is:

1. Duplex stainless steel characterized by containing, by mass %, C: 0.06% or less, Si: 0.05 to 3.0%, Mn: 0.1 to 6.0%, P: 0.05% or less, S: 0.010% or less, Ni: 1.0 to 10.0%, Cr: 18 to 30%, Mo: 3.0% or less, Cu: 3.0% or less, N: 0.10 to 0.40%, Al: 0.001 to 0.08%, Ti: 0.003 to 0.042%, Mg: 0.0001 to 0.0030%, and O: 0.010% or less, having a product of $f_N$, Ti content, and N content as $f_N \times Ti \times N$ of 0.00004%$^2$ or more, having a product of Ti content and N content as Ti×N of 0.008%$^2$ or less, having a balance of Fe and unavoidable impurities;

where $f_N$ is a numerical value satisfying the following formula (1):

$$\log_{10} f_N = -0.046 \times Cr - 0.02 \times Mn - 0.011 \times Mo + 0.048 \times Si + 0.007 \times Ni + 0.009 \times Cu \quad (1)$$

each element is shown by content (%), and having an equiaxial crystal structure and a ferrite phase ratio in the range of 30 to 70%.

2. Duplex stainless steel according to claim 1, further containing, by mass %, one or more of V: 0.05 to 1.0%, Nb: 0.01 to 0.20%, W: 0.05 to 3.0%, and Co: 0.05 to 1.0%.

3. Duplex stainless steel according to claim 1, containing, by mass %, O: 0.0014 to 0.010%.

4. Duplex stainless steel according to claim 1, having an average grain size of not more than 2.0 mm.

5. Duplex stainless steel according to claim 1, having an average grain size of not more than 1.5 mm.

6. Duplex stainless steel according to claim 1, having an impact transition temperature of 0° C. or less.

7. Duplex stainless steel according to claim 1, when rolled into a steel plate has an impact value in a direction perpendicular to rolling direction at 0° C. of 250 J/cm$^2$ or more.

8. Duplex stainless steel superior in hot workability characterized by containing, by mass %, C: 0.06% or less, Si: 0.05 to 3.0%, Mn: 0.1 to 6.0%, P: 0.05% or less, S: 0.0020% or less, Ni: 1.0 to 10.0%, Cr: 18 to 30%, Mo: 3.0% or less, Cu: 3.0% or less, N: 0.10 to 0.40%, Al: 0.010 to 0.08%, Ti: 0.003 to 0.042%, Mg: 0.0001 to 0.0030%, and O: 0.010% or less, having a product of $f_N$, Ti content, and N content as $f_N \times Ti \times N$ of 0.00004%$^2$ or more, having a product of Ti content and N content as TixN of 0.008%$^2$ or less, further containing one or more of B: 0.0005 to 0.0050%, Ca: 0.0005 to 0.0050%, and REM: 0.005 to 0.10%, having a balance of Fe and unavoidable impurities;

where $f_N$ is a numerical value satisfying the following formula (1):

$$\log_{10} f_N = 0.046 \times Cr - 0.02 \times Mn - 0.011 \times Mo + 0.048 \times Si + 0.007 \times Ni + 0.009 \times Cu \quad (1)$$

each element is shown by content (%), and having an equiaxial crystal structure and a ferrite phase ratio in the range of 30 to 70%.

9. Duplex stainless steel superior in hot workability according to claim 8, further containing, by mass %, one or more of V: 0.05 to 1.0%, Nb: 0.01 to 0.20%, W: 0.05 to 3.0%, and Co: 0.05 to 1.0%.

10. Duplex stainless steel superior in hot workability according to claim 8, containing, by mass %, O: 0.0014 to 0.010%.

11. Duplex stainless steel according to claim 8, having an average grain size of not more than 2.0 mm.

12. Duplex stainless steel according to claim 8, having an average grain size of not more than 1.5 mm.

13. Duplex stainless steel according to claim 8, having an impact transition temperature of 0° C. or less.

14. Duplex stainless steel according to claim 8, when rolled into a steel plate has an impact value in a direction perpendicular to rolling direction at 0° C. of 250 J/cm$^2$ or more.

* * * * *

UNITED STATES PATENT AND TRADEMARK OFFICE

CERTIFICATE OF CORRECTION

PATENT NO. : 8,778,260 B2
APPLICATION NO. : 11/991671
DATED : July 15, 2014
INVENTOR(S) : Shinji Tsuge et al.

It is certified that error appears in the above-identified patent and that said Letters Patent is hereby corrected as shown below:

In the Specification

Column 3, line 55, change "ϵCu" to -- εCu --;

In the Claims

Column 10, line 37, change "$\log_{10} f_N = 0.046\times Cr-0.02\times Mn-0.011\times Mo+0.048\times Si+0.007\times Ni+0.009\times Cu$" to -- $\log_{10} f_N = -0.046\times Cr-0.02\times Mn-0.011\times Mo+0.048\times Si+0.007\times Ni+0.009\times Cu$ --.

Signed and Sealed this
First Day of September, 2015

Michelle K. Lee

Michelle K. Lee
*Director of the United States Patent and Trademark Office*